US006361727B1

(12) United States Patent
Fildan

(10) Patent No.: US 6,361,727 B1
(45) Date of Patent: Mar. 26, 2002

(54) METHOD OF FORMING BRASSIERES UNDERWIRES

(76) Inventor: Gerhard Fildan, Wohnpark Alte Erlaa, Anton Baumgartner Str. 44, C 4 17 01 Vienna (AT)

( * ) Notice: Subject to any disclaimer, the term of this patent is extended or adjusted under 35 U.S.C. 154(b) by 0 days.

(21) Appl. No.: 09/512,399

(22) Filed: Feb. 24, 2000

(51) Int. Cl.[7] ..... B29C 45/14

(52) U.S. Cl. ..... 264/157; 264/247; 264/251; 264/279; 264/295; 264/320; 264/325; 264/254

(58) Field of Search ..... 450/41, 42, 43, 450/45, 47, 48, 51, 52; 2/255, 259, 258; 264/157, 151, 148, 159, 279, 251, 254, 247, 295, 320, 325

(56) References Cited

U.S. PATENT DOCUMENTS 2,731,640 A * 1/1956 Garson ..... 2/42
4,292,267 A * 9/1981 Haynes ..... 264/157
4,777,668 A * 10/1988 Weston ..... 2/257
5,167,891 A * 12/1992 Dijkman, Sr. et al. ..... 264/145

FOREIGN PATENT DOCUMENTS

JP 63-56439 A * 3/1988

* cited by examiner

*Primary Examiner*—Jan H. Silbaugh
*Assistant Examiner*—Edmund H. Lee
(74) *Attorney, Agent, or Firm*—Herbert Dubno

(57) ABSTRACT

Brassiere underwires are made in a three step process in which, initially, pairs of injection molded polyamide tips are formed on a continuous flexible strand of carbon fiber or aramid fiber material which can be baked to impart stiffness thereto. In a second step, the strand is cut between the tips to form lengths having the tips at extremities thereof. The lengths are then shaped in a half barrel or plate mold and baked to harden the materials.

14 Claims, 4 Drawing Sheets

METHOD OF FORMING BRASSIERES UNDERWIRES

FIELD OF THE INVENTION

My present invention relates to a method of making brassiere underwires and to brassiere underwires made by the improved method.

BACKGROUND OF THE INVENTION

Brassiere underwires are generally composed of metal or plastic and can be received in a slender pocket stitched beneath For the cup of a brassiere or formed as part of a brassiere frame. The underwire in parts shape to the brassiere and retains the shape of the cup. It is known to provide such underwires with tips at the ends thereof to prevent the underwire from poking through the fabrication of the brassieres and injuring the wearer and to provide the underwire, in addition, with a sewing flange, holds the tip or like means to enable the underwire to be stitched in place in the brassieres.

When the underwire is composed of metal, it is usually covered by a sheath of a plastic material and the tips can be injection molded onto the shaped wire.

While brassiere underwires have undergone considerable developments in the last decade, earlier underwires are still unsatisfactory for a variety of reasons. For example, the underwire may have insufficient stiffness in one or more planes or maybe so stiff as to be uncomfortable. Tips may pull off the underwire or may be incapable of preventing the underwire from poking through the fabrication. The underwire may have to be accessibly large to provide the requisite degree of stiffness or composed of a material which is effected by laundering and drying in normal use. By and large, therefore, the fabrication of brassiere underwires has called for further improvement.

OBJECTS OF THE INVENTION

It is, therefore, the principal object of the present invention to provide an improved method of making a brassiere underwire, whereby drawbacks of earlier underwires and there methods of fabrication can be obviated.

It is also an object of the invention to provide an improved brassiere underwire.

Yet another object of the invention is to provide an article of manufacture which can be readily formed into a brassiere underwire.

SUMMARY OF THE INVENTION

These objects are attained, in accordance with the invention in a method of making brassiere underwires which comprises the steps of:

(a) forming a continuous strand of a hardenable material and applying at spaced-apart locations therealong, corresponding to desired lengths of brassiere underwires, pairs of thermoplastic tips each surrounding the strand;

(b) cutting the strand between the tips of each pair to separate the strand into successive lengths each having respective tips at extremities thereof; and (c) shaping each of the lengths into a curved underwire shape and hardening the material of the shaped lengths to form a respective brassier underwire therefrom preformed with respective tips at the extremities thereof.

According to the invention, each of the pairs of tips are bridged by a thermoplastic web upon injection molding thereof onto the strand. The webs are cut away during the cutting of the strand into lengths. The lengths can be shaped in a half barrel mold in which the hardenable material, usually a carbon fiber or aramid fiber reinforced material such as a thermosetting resin can be baked as part of the hardening process.

Alternatively, the lengths can be shaped in cavities in a two plate mold.

According to a feature of the invention, the strand is formed as a fiber reinforced tube and that tube may be hollow or formed on a flexible polymeric core, e.g. of polyamide.

The tips are injection molded onto the continuous strand as thermoplastic members, e.g. of a polyamide.

Since the tips are formed on the strand at distances between them which determine the arc lengths and hence the size of the underwire for a particular size of brassieres, I may provide the tips of different colors as a function of the distances between the spaced apart locations so that the color of the tip can indicate the underwire size.

According to another feature of the invention, a sewing flange is formed on at least one of the tips of each pair. A soft zone can advantageously be provided between each tip and a hardened remainder of a respective length of each underwire.

According to yet another feature of the invention, the strand is originally formed with a circular cross section and that cross sectional shape is transformed into an oval during the molding and baking step.

The invention also is a brassiere can be comprised of an arcuate carbon fiber or aramid fiber wire segment formed with the injection molded tips at the extremities thereof and an article of manufacture adapted to produce brassiere underwires and which comprises the continuous strand of the hardenable material and pairs of plastic tips each surrounding the strand and located at spaced apart locations there along so that, when the strand is cut between the tips of each pair, individual lengths are formed which can be shaped to form the brassiere underwire.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
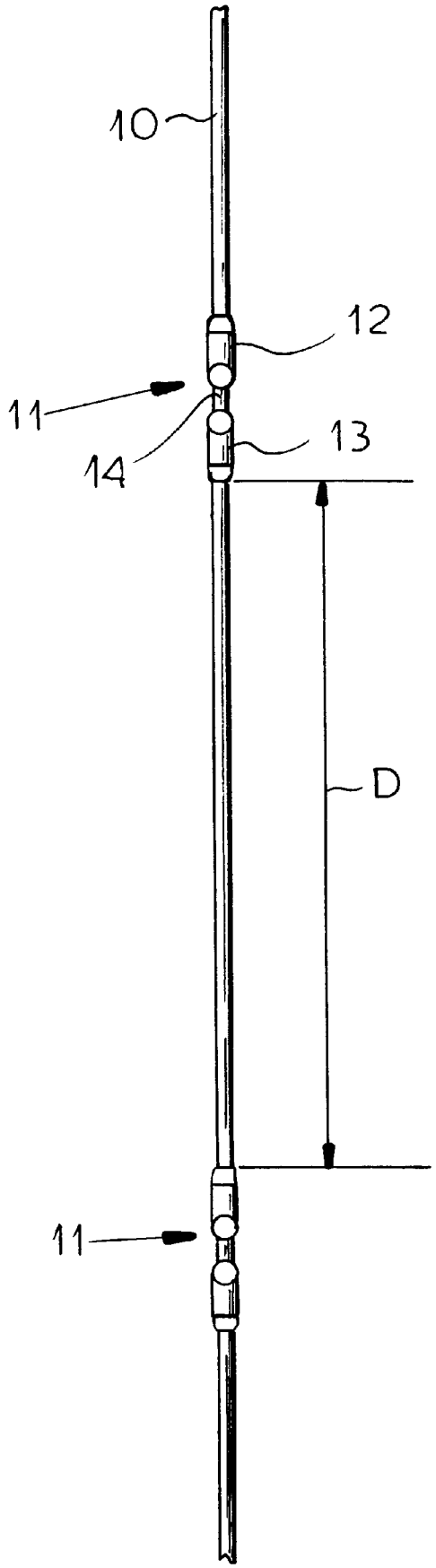
FIG. 1 is an elevational view of a strand formed in the first step of the method of the invention.

In FIG. 1 I have shown a continuous strand 10 which can be composed of a fiber-reinforced thermosetting synthetic resin which can be baked to harden the strand but which is extruded and after being extruded is provided with pairs 11 of thermoplastic polyamide tips 12 and 13 interconnected by webs 14 at distances D defining the lengths of respective underwires. The distance D, of course, defines the size of the underwire and the thermoplastic tips can have different colors corresponding to the different sizes of underwires which are produced.

Figure 2:
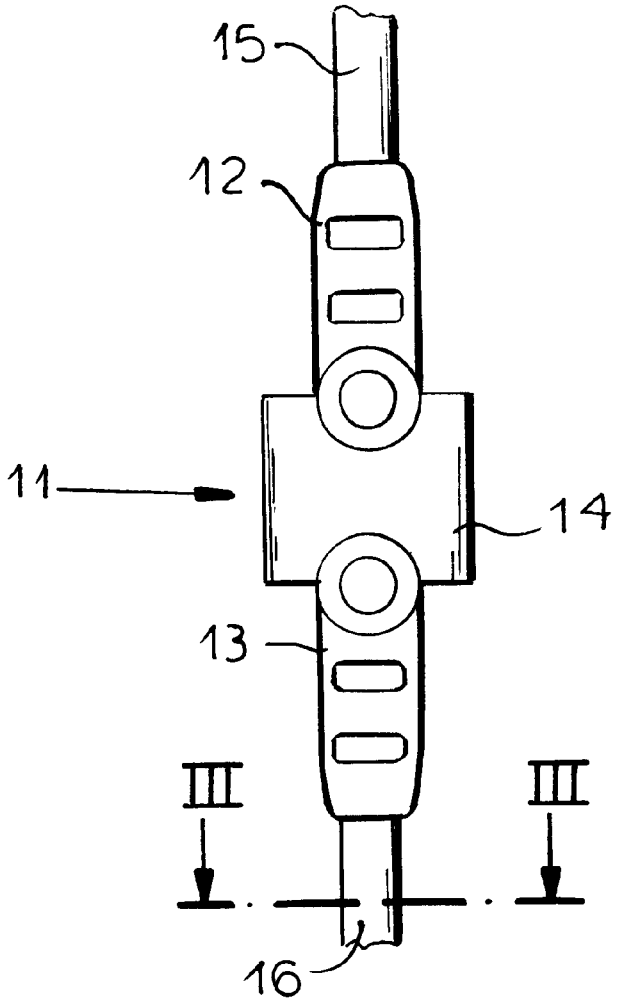
FIG. 2 is a detailed view showing the pair of tips molded into the strand.

As can be seen from FIG. 2, the web 14 can be cut away in the next step of processes to leave the tips 12 and 13 on the respective lengths 15 and 16 of the carbon fiber or aramid fiber tube forming the strand.

Figure 3:
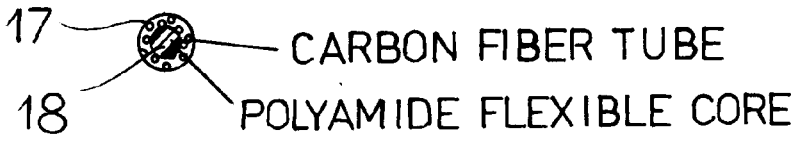
FIG. 3 is a cross sectional view taken along the lines III—III of FIG. 2.
Figure 5:
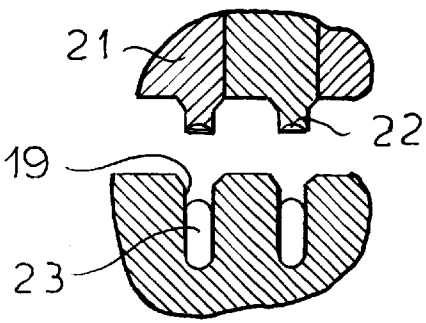
FIG. 5 is a cross sectional view showing the step of imparting an oval shape to the strand.
Figure 4:
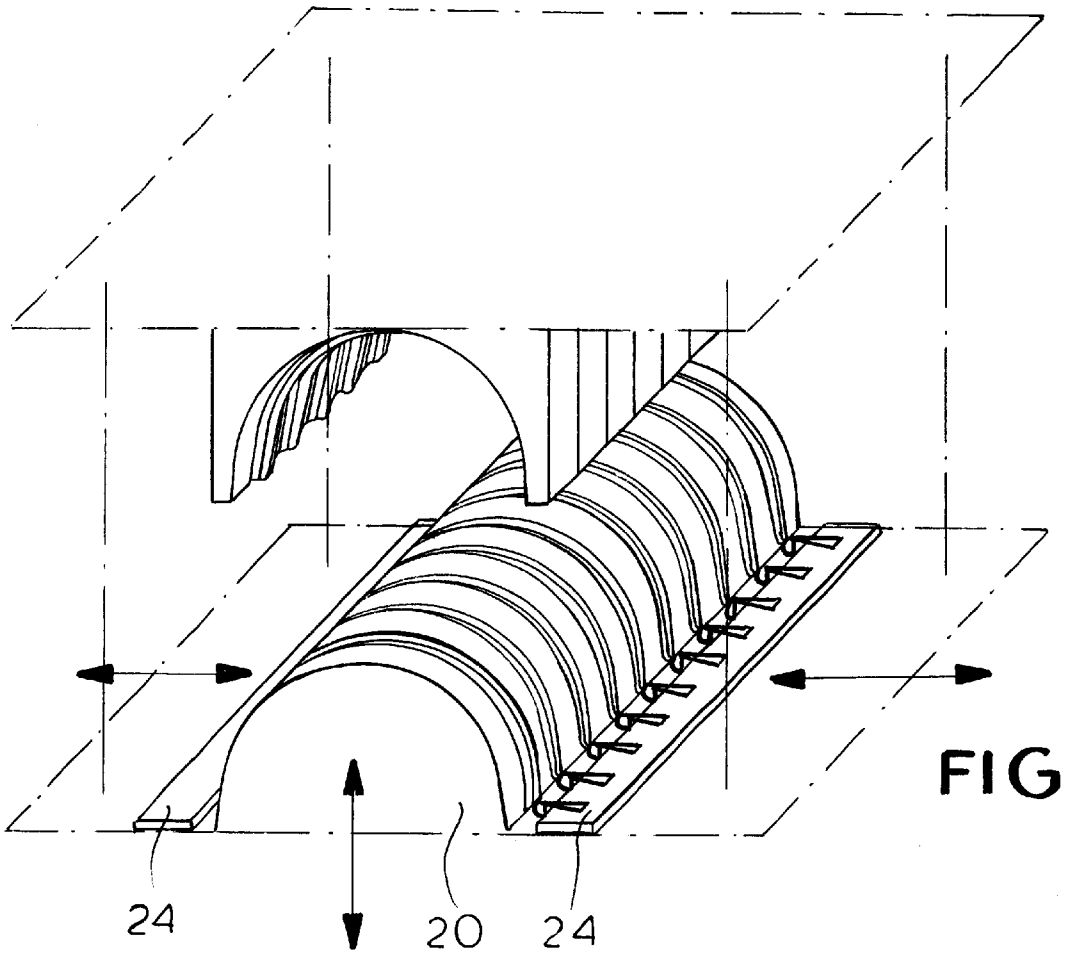
FIG. 4 is a diagrammatic perspective view showing the use of a half barrel mold in shaping the brassiere underwires.

As has been shown in FIG. 3, the carbon fiber tube 17 can be provided on a polyamide core 18 which is flexible, as is the tube 17.

Figure 7:
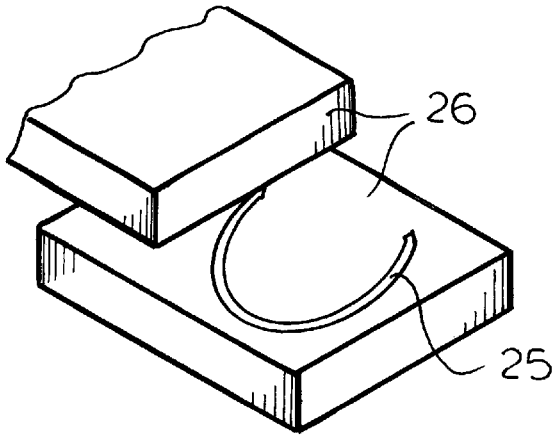
FIG. 7 is a diagrammatic perspective view showing a two plate mold for shaping the underwires.
Figure 6:
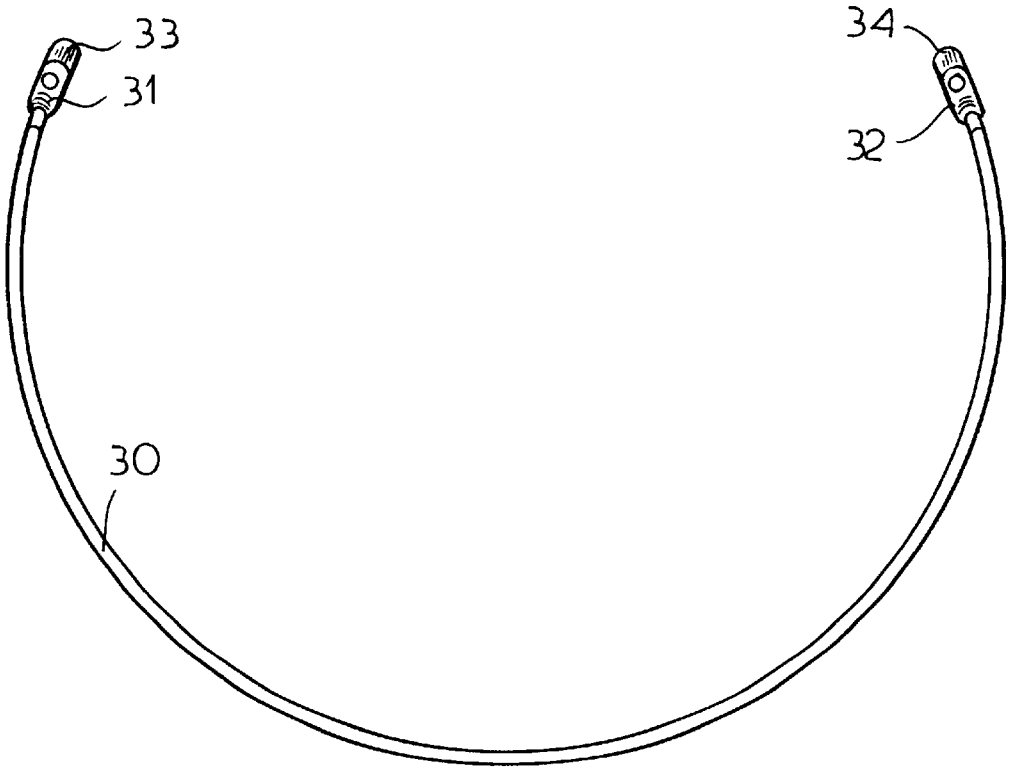
FIG. 6 is an elevational view of the underwire product.

After being cut into lengths, the lengths can be placed in grooved beds 19 of a half barrel mold 20 and the male mold member 21 can be closed thereon. The bed 19 and the ribs 22 of the two mold members can shape the cross section of the resulting underwire so that it is generally oval as shown at 23. The flattened cross section may lie in the plane of the underwire. To protect the tips, the half barrel mold may be formed with members 24 movable inwardly against the half barrel mold and preventing deformation of the tip under the heat and pressure used to bake the carbon fiber or armed fiber to the desired stiffness. As shown in FIG. 7,, strands 15 and 16 can be placed in cavities 25 of a double plate mold 26 for the baking process. The resulting underwire 30 has the molded tips 31 and 32 at its ends (FIG. 6) and these tips may be provided with thin sewing flanges 33 and 34 of the thermoplastic material from which the tips are molded.

I claim:

1. A method of making brassiere underwires comprising the steps of:

(a) forming a continuous strand of a hardenable material and applying at spaced-apart locations therealong, corresponding to desired lengths of brassiere underwires, pairs of thermoplastic brassiere-underwire tips each surrounding the strand;

(b) cutting said strand between the brassiere-underwire tips of each pair to separate said strand into successive lengths each having respective brassiere-underwire tips at extremities thereof; and (c) shaping each of said lengths into a curved underwire shape in a mold and hardening the material of the shaped lengths to form a respective brassiere underwire therefrom preformed with respective brassiere-underwire tips at the extremities thereof.

2. The method defined in claim 1 wherein each of said pairs of brassiere-underwire tips have the brassiere-underwire tips thereof interconnected by a web of thermoplastic, said webs being cut away during the cutting of said strand in step (b).

3. The method defined in claim 2 wherein said lengths are shaped by placing said lengths on a half-barrel mold and baking said lengths on said half-barrel mold.

4. The method defined in claim 2 wherein said lengths are shaped by placing said lengths in cavities of a two-plate mold and baking said lengths in said two-plate molds.

5. The method defined in claim 2 wherein said strand is formed as a fiber tube.

6. The method defined in claim 5 wherein said tube is a carbon fiber or aramid fiber tube.

7. The method defined in claim 6 wherein said tube is formed on a flexible polymeric core.

8. The method defined in claim 7 wherein said polymeric core is a polyamide core.

9. The method defined in claim 1 wherein said thermoplastic brassiere-underwire tips are injection molded onto said strand.

10. The method defined in claim 9 wherein said brassiere-underwire tips are injection molded from a polyamide.

11. The method defined in claim 9 wherein brassiere underwire tips of different colors are injection molded onto said strand as a function of distances between said spaced-apart locations, thereby indicating different sizes of said underwires.

12. The method defined in claim 2, further comprising forming a sewing flange on at least one of the tips of each pair.

13. The method defined in claim 2, further comprising forming a soft zone between each tip and a hardened remainder of a respective length of each underwire.

14. The method defined in claim 2 wherein said strand is formed with a circular cross section and in the shaping of said lengths in step (c) the circular cross section is converted into an oval cross section of the respective brassiere underwire.

* * * * *